US010774551B1

(12) United States Patent
Ruiz

(10) Patent No.: US 10,774,551 B1
(45) Date of Patent: Sep. 15, 2020

(54) CLAMPING DEVICE FOR DRYWALL REPAIR

(71) Applicant: Harry Ruiz, Naples, FL (US)

(72) Inventor: Harry Ruiz, Naples, FL (US)

( * ) Notice: Subject to any disclaimer, the term of this patent is extended or adjusted under 35 U.S.C. 154(b) by 0 days.

(21) Appl. No.: 16/456,635

(22) Filed: Jun. 28, 2019

(51) Int. Cl.
*E04G 23/02* (2006.01)

(52) U.S. Cl.
CPC ..... *E04G 23/0207* (2013.01)

(58) Field of Classification Search
CPC ..... E04G 23/0207; E04G 23/02
See application file for complete search history.

(56) References Cited

U.S. PATENT DOCUMENTS 3,965,540 A 6/1976 Moore
4,178,730 A * 12/1979 Rowinski ..... E04G 23/02 52/514
4,498,272 A * 2/1985 Adams ..... E04F 13/0844 52/363
4,703,603 A 11/1987 Hills
5,079,888 A * 1/1992 Hileman ..... E04G 23/0207 52/514
5,297,889 A 3/1994 Crouse et al.
5,966,893 A 10/1999 Quillin
6,018,923 A 2/2000 Wendt
6,088,986 A * 7/2000 DiGate ..... E04G 23/0207 52/514
6,209,277 B1 * 4/2001 DiGate ..... E04F 13/0841 52/514
6,792,733 B2 9/2004 Wheeler et al.
7,444,792 B2 11/2008 Matson
7,543,420 B2 6/2009 Holt
8,915,044 B2 12/2014 Kline
2006/0185278 A1 8/2006 Jaffe
2007/0107348 A1 5/2007 Browne et al.
2008/0110120 A1 5/2008 Misbin
2009/0276988 A1 11/2009 Garza
2009/0282768 A1 11/2009 Notumo
2010/0242386 A1 9/2010 Wambaugh et al.

* cited by examiner

*Primary Examiner* — Andrew J Triggs
(74) *Attorney, Agent, or Firm* — Dunlap Bennett & Ludwig, PLLC

(57) ABSTRACT

A drywall repair device includes a base having a front surface and a rear surface. The front surface includes a first side and a second side. A clamping member is coupled to the base at the first side. The clamping member is configured to clamp drywall in between the clamping member and the first side of the front surface of the base. An adhesive is adhered to the second side of the front surface of the base.

3 Claims, 3 Drawing Sheets

CLAMPING DEVICE FOR DRYWALL REPAIR

BACKGROUND OF THE INVENTION

The present invention relates to patching drywall holes and, more particularly, to a clamping device for drywall repair.

Drywall is a common construction material used in both new and used residential and business applications. After drywall is installed, damage can occur from a number of sources. For example, a door handle may poke a hole into an existing drywall installation.

Conventional systems for patching such holes involve placing some sort of backing material inside the hole. The backing material needs to be glued or otherwise secured to the inside of the damaged drywall area. The backing material drys, a drywall patching material (often in a paste form) is applied, sanded, finished, etc. This process can be difficult and requires the use of tools.

As can be seen, there is a need for an easier method of patching drywall holes.

SUMMARY OF THE INVENTION

In one aspect of the present invention, a drywall repair device comprises: a base comprising a front surface and a rear surface, wherein the front surface comprises a first side and a second side; a clamping member coupled to the base and configured to clamp drywall in between the clamping member and the first side of the front surface of the base; and an adhesive adhered to the second side of the front surface of the base.

In another aspect of the present invention, a method of attaching a patch to drywall comprises the steps of: providing a plurality of drywall repair devices each comprising: a base comprising a front surface and a rear surface, wherein the front surface comprises a first side and a second side; a clamping member coupled to the base on the first side of the front surface; and an adhesive adhered to the second side of the front surface of the base; coupling the plurality of drywall repair devices to an inner edge of an opening of a drywall by clamping the drywall in between the clamping member and the first side of the front surface of the base; and adhering a drywall patch to the adhesives.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an exterior clamp slidably coupled to a base. The clamp includes teeth that interlocks with a locking pawl, allowing the clamp to slide in but not out. The clamp coupled to the base creates an H-shape.

The present invention includes an adjustable clip to felicitate professional drywall repairs. Due to the adjustability, the present invention may be used with different drywall thicknesses. The present invention further uses a pawl for a one directional lock so that once it is adjusted for a specific drywall thickness it locks in place and won't come off or dis-adjust. The present invention may further include an adhesive bed to adhere the new drywall piece to the drywall without the need of power tools or screws.

Figure 1:
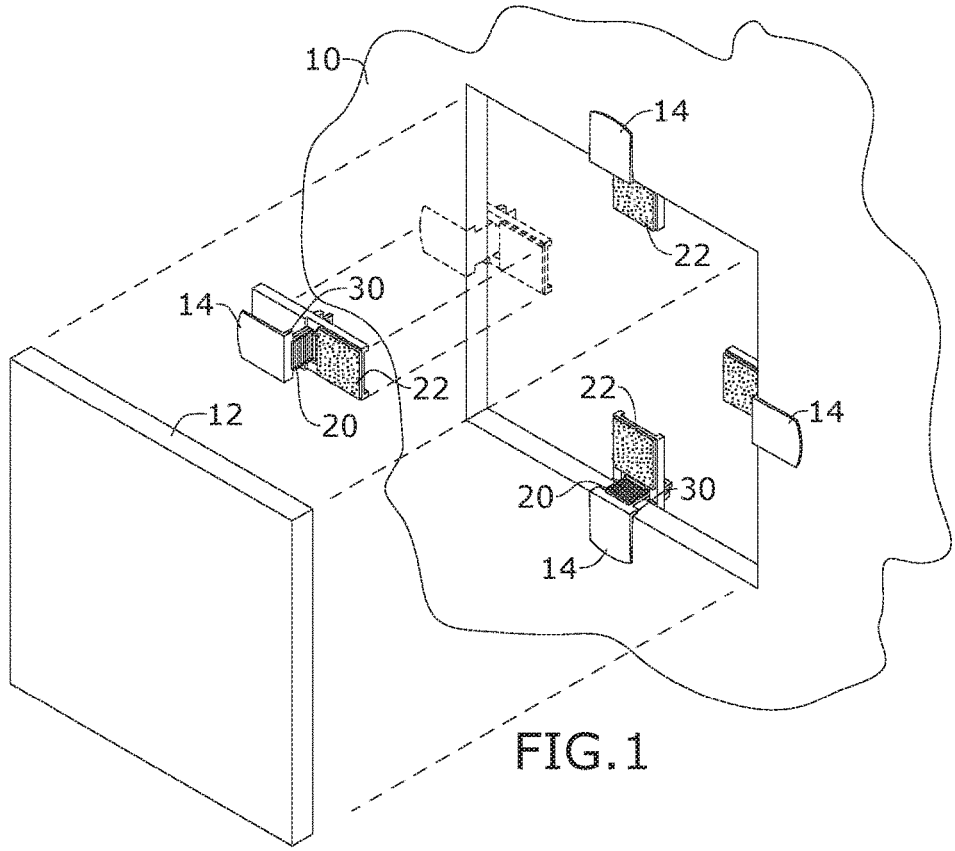
FIG. 1 is a perspective view of an embodiment of the present invention, shown in use.
Figure 2:
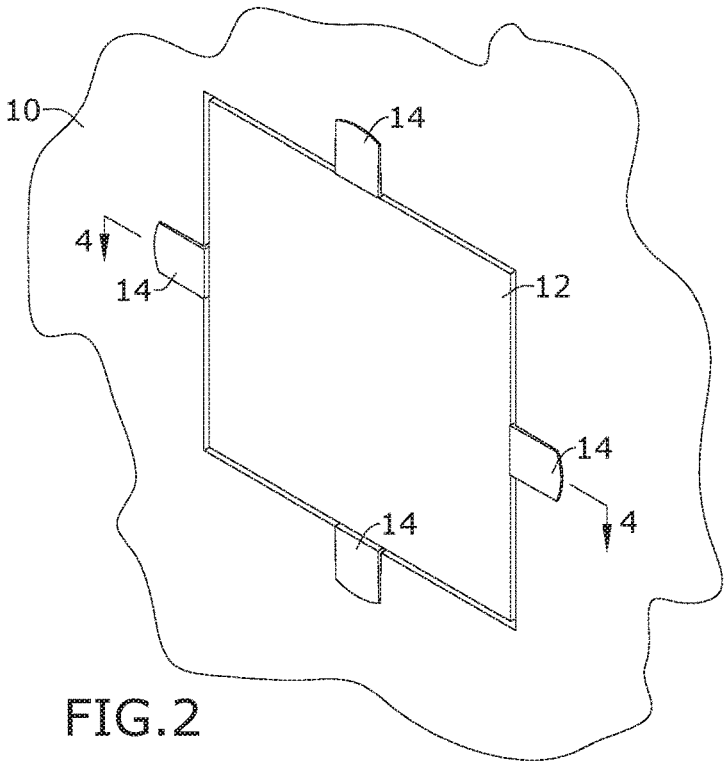
FIG. 2 is a perspective view of an embodiment of the present invention, shown in use.
Figure 3:
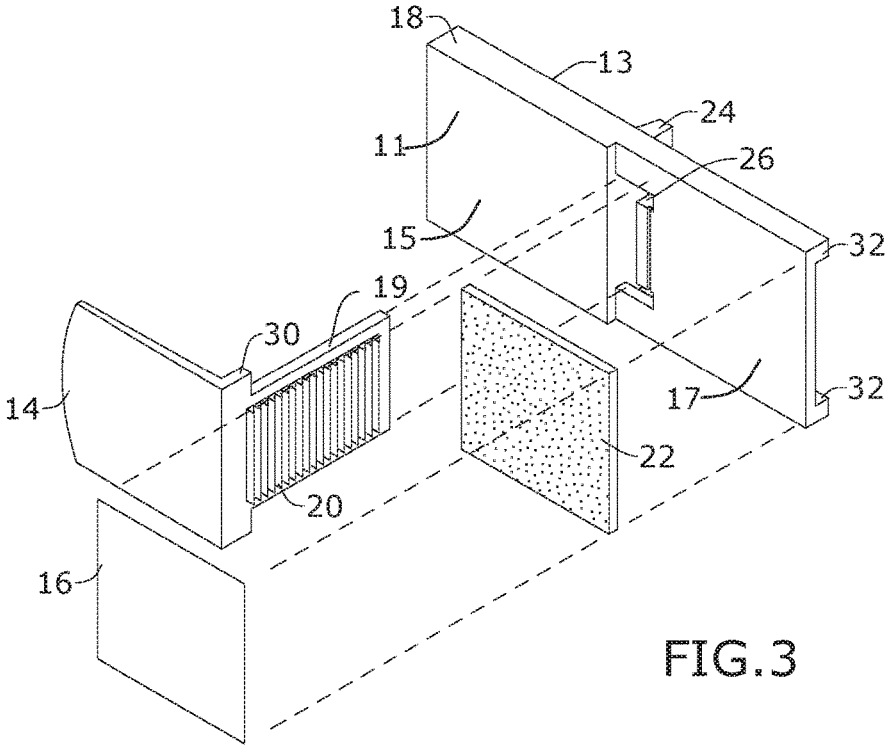
FIG. 3 is an exploded view of an embodiment of the present invention.
Figure 4:
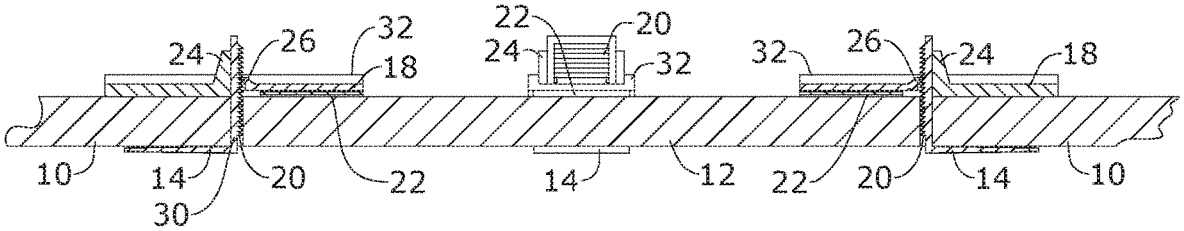
FIG. 4 is a cross sectional view taken along line 4-4 in FIG. 2.
Figure 5:
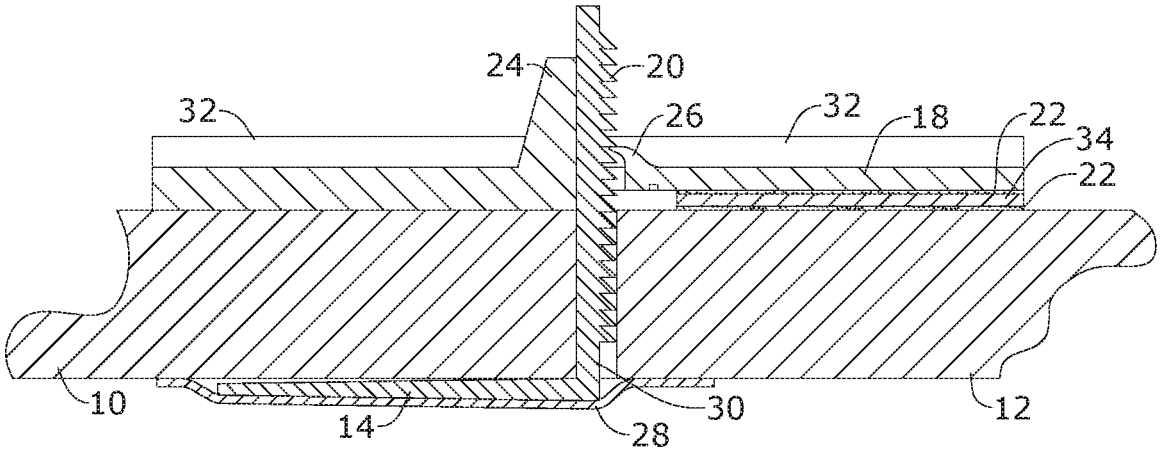
FIG. 5 is a detailed perspective view of an embodiment of the present invention.

Referring to FIGS. 1 through 5, the present invention includes a drywall repair device. The drywall repair device includes a base 18 having a front surface 11 and a rear surface 13. The front surface 11 includes a first side 15 and a second side 17. A clamping member 14, 19 is coupled to the base 18 at the first side 15. The clamping member 14, 19 is configured to clamp drywall 10 in between the clamping member 14, 19 and the first side 15 of the front surface 11 of the base 18. An adhesive 22 is adhered to the second side 17 of the front surface 11 of the base 18.

The clamping member 14, 19 includes a vertical member 19 and a horizontal member 14. The vertical member 19 includes a plurality of teeth 20. The vertical member 19 runs through a slot of the base 18. A pawl 26 is coupled to the base 18 and disposed in the slot. The plurality of teeth 20 interlock with a pawl 26 of the base 18. The pawl 26 allows the vertical member 19 to be pushed inward but prevents the vertical member 19 from coming back out of the base 18. A guide member 24 protrudes from the rear surface of the base 18 at the slot and guides the vertical member 19 through the slot and prevents the vertical member 19 from pivoting and dislodging from the pawl 26. Bridge ribs 32 protrude from opposing edges of the rear surface along a length of the base 18, providing structural integrity. Lateral stops 30 protrude from opposing sides of a proximal end of the vertical member 19.

A method of attaching a patch 12 to drywall 10 may include the following steps. Provide a plurality of drywall repair devices described above. Couple the plurality of drywall repair devices to an inner edge of an opening of a drywall 10 by clamping the drywall 10 in between the clamping member 14, 19 and the first side 15 of the front surface 11 of the base 18. Coupling the plurality of drywall repair devices to the inner edge may include placing the inner edge of the drywall 10 in between the horizontal member 14 and the first side 15 of the front surface 11 of the base 18 and pressing the horizontal member 14 inward towards the drywall 10. The vertical member 19 is pushed through the slot and the plurality of teeth 20 interlock with the pawl 26. Remove an adhesive cover 16 from the adhesive 22. Adhere a drywall patch 12 to the adhesives 22. Apply a spackle over the drywall patch 12 and the drywall 10.

It should be understood, of course, that the foregoing relates to exemplary embodiments of the invention and that modifications may be made without departing from the spirit and scope of the invention as set forth in the following claims.

What is claimed is:

1. A method of attaching a patch to drywall comprising the steps of:

providing a plurality of drywall repair devices each comprising:

a base comprising a front surface and a rear surface, wherein the front surface comprises a first side and a second side;

a clamping member coupled to the base on the first side of the front surface, wherein the clamping member comprises a vertical member and a horizontal member, wherein the vertical member comprises a plurality of teeth and runs through a slot of the base, wherein the plurality of teeth interlock with a pawl of the base; and an adhesive adhered to the second side of the front surface of the base;

coupling the plurality of drywall repair devices to an inner edge of an opening of a drywall by clamping the drywall in between the clamping member and the first side of the front surface of the base; and adhering a drywall patch to the adhesives, wherein the step of coupling the plurality of drywall repair devices to the inner edge comprises:

placing the inner edge of the drywall in between the horizontal member and the first side of the front surface of the base; and pressing the horizontal member inward towards the drywall, wherein the vertical member is pushed through the slot and the plurality of teeth interlock with the pawl.

2. The method of claim 1, further comprising a step of applying a spackle over the drywall patch and the drywall.

3. The method of claim 1, wherein the plurality of drywall repair devices each comprise bridge ribs protruding from opposing edges of the rear surface along a length of the base.

* * * * *